US006624410B1

(12) United States Patent
Voss

(10) Patent No.: US 6,624,410 B1
(45) Date of Patent: Sep. 23, 2003

(54) CYCLOIDAL MASS SPECTROMETER

(75) Inventor: Guenter F. Voss, Much (DE)

(73) Assignee: Monitor Instruments Company, LLC, Cheswick, PA (US)

( * ) Notice: Subject to any disclaimer, the term of this patent is extended or adjusted under 35 U.S.C. 154(b) by 0 days.

(21) Appl. No.: 10/082,684

(22) Filed: Feb. 25, 2002

(51) Int. Cl.[7] ..... H01J 39/34; H01J 49/30; H01J 7/24

(52) U.S. Cl. ..... 250/291; 250/281; 250/282; 250/294; 250/298

(58) Field of Search ..... 250/291, 290, 250/281, 282, 296, 298, 299, 300, 423 R, 427

(56) References Cited

U.S. PATENT DOCUMENTS

| | | | | |
|---|---|---|---|---|
| 2,780,729 A | * | 2/1957 | Robinson et al. | 250/297 |
| 2,795,701 A | * | 6/1957 | Robinson | 250/297 |
| 2,844,726 A | * | 7/1958 | Robinson | 250/297 |
| 2,882,410 A | | 4/1959 | Brobeck | |
| 3,010,017 A | * | 11/1961 | Brubaker et al. | 250/297 |
| 3,070,951 A | | 1/1963 | Hetzel | |
| 3,437,805 A | * | 4/1969 | Brown | 250/297 |
| 3,497,688 A | * | 2/1970 | Brown et al. | 250/290 |
| 3,590,243 A | | 6/1971 | Perrin et al. | |
| 3,670,162 A | * | 6/1972 | Elmore | 250/296 |
| 4,298,795 A | | 11/1981 | Takeuchi et al. | |
| 4,542,321 A | * | 9/1985 | Singh et al. | 250/423 R |
| 4,649,279 A | * | 3/1987 | Delmore | 250/424 |
| 4,882,485 A | | 11/1989 | Duryea | |
| 4,952,802 A | | 8/1990 | Duryea | |
| 5,210,413 A | * | 5/1993 | Balzer | 250/281 |
| 5,304,799 A | | 4/1994 | Kurzweg | |
| 5,572,025 A | * | 11/1996 | Cotter et al. | 250/282 |

FOREIGN PATENT DOCUMENTS

| | | | | |
|---|---|---|---|---|
| DE | 1598861 | * | 8/1970 | |
| JP | 11345591 A | * | 12/1999 | H01J/49/28 |
| SU | 396614 A | * | 1/1974 | B01D/59/44 |

* cited by examiner

*Primary Examiner*—John R. Lee
*Assistant Examiner*—Bernard E. Souw
(74) *Attorney, Agent, or Firm*—Arnold B. Silverman; Eckert Seamans Cherin & Mellott, LLC

(57) ABSTRACT

A circular cycloidal mass spectrometer has an outer electrode of generally circular configuration and an inner electrode having a generally circular outer periphery with an annulus for the flow of ions defined therebetween. The electrodes are structured to create an electric field therebetween. A magnetic field generator is structured to create a magnetic field oriented generally perpendicular to said electric field. An ion beam source for injecting ions into the annulus for travel therearound is provided, and an ion exit for discharge of the ions traveling in said annulus is provided with an ion collector being disposed adjacent to the ion exit. The circular cycloidal mass spectrometer may be structured to provide, under the influence of the electric field and magnetic field, a path of travel for the ion beams, which is similar to either epicycloidal or hypocycloidal curves. If desired, elliptical shapes or other suitable shapes providing a nonlinear path of ion travel may be employed. A filter may be interposed between said outer electrode and said inner electrode.

21 Claims, 14 Drawing Sheets

CYCLOIDAL MASS SPECTROMETER

BACKGROUND OF THE INVENTION

1. Field of the Invention

The present invention provides a cycloidal mass spectrometer, which has inner and outer electrodes defining an annulus for passage of an electron beam therethrough and, more specifically, it provides such a cycloidal mass spectrometer, which permits a reduction in the number of electrodes and size, as compared with prior art cycloidal mass spectrometers.

2. Description of the Prior Art

The use of mass spectrometers in determining the identity and quantity of constituent materials in a gaseous, liquid or solid specimen has long been known. It has been known, in connection with such systems, to analyze the specimen under vacuum through conversion of the molecules into an ionic form, separating the ions by mass to charge ratio, and permitting the ions to bombard a detector. See, generally, U.S. Pat. Nos. 2,882,410; 3,070,951; 3,590,243; and 4,298,795. See, also, U.S. Pat. Nos. 4,882,485 and 4,952,802.

In general, mass spectrometers contain an ionizer inlet assembly wherein the specimen to be analyzed is received, a high vacuum chamber which cooperates with the ionizer inlet, an analyzer assembly which is disposed within the high vacuum chamber and is adapted to receive ions from the ionizer. Detector means are employed in making a determination as to the constituent components of the specimen employing mass to charge ratio as a distinguishing characteristic. By one of many known means, the molecules of the gaseous specimen contained in the ionizer are converted into ions, which are analyzed by such equipment.

It has been known with prior art cycloidal mass spectrometers to use a simple fixed collector and ramped electric field in looking at only one mass to charge ratio at a time. In many prior art mass spectrometer systems, regardless of whether they were of the cycloidal type or not, the ionizers were quite large and, as a result, dominated the design and specifications of the systems to be employed therewith.

U.S. Pat. No. 5,304,799 discloses a cycloidal mass spectrometer having a housing defining an ion trajectory volume, an electric field generator for establishing an electric field within the ion trajectory volume and an ionizer for receiving gaseous specimens to be analyzed and converting the same into ions, which travel through orthogonal electric and magnetic fields and subsequently impinge on a collector. This spectrometer was designed to have a plurality of different ions mass to charge ratios impinging on the collector generally simultaneously. It was stated that the cycloidal mass spectrometer and ionizer may be miniaturized to as provide a small readily portable instrument.

Cycloidal mass spectrometers belong to the so-called crossed field spectrometer group. In such spectrometers, charged particles move in magnetic and electric fields that are perpendicular to each other. In a uniform magnetic field as shown in FIG. 1, a charged particle moves in a circular path 2 determined by its mass, its charge, its speed and the magnetic field strength. The magnetic field may be established by pole pieces 3,4, the magnetic field as shown is parallel to the z axis and the electrical field is perpendicular thereto. The magnetic field may be generated by either a permanent magnet or electromagnet. The cycle's frequency is determined by the time periods of the particle returning to a point in its trajectory. If a uniform electric field is imposed, normally across the magnetic field, the motion of the particle is imposed by a uniform motion rectangular to both fields as shown in FIG. 2. In this figure, the magnetic field is parallel to the z axis and the electric field is parallel to the y axis.

A particle of a given mass will cross a reference plane at equivalent locations that are separated by a fixed distance, which is designated the pitch of the periodic motion. Particles with different molecular weights return at different pitches to equivalent points in their trajectory, which is the separation effect of this type of mass spectrometry. An example of such separation and travel is shown in FIG. 3.

Cycloidal mass spectrometers of the prior art are generally based on the uniformity of the fields that result in a circular motion imposed by a linear motion of the charged particles.

The present invention focuses on field structures of a cycloidal mass spectrometer wherein the circular motion is imposed by another circular motion, thereby providing circular symmetry as shown in FIG. 4.

SUMMARY OF THE INVENTION

The present invention has provided a number of improvements in cycloidal mass spectrometers by providing a circular cycloidal mass spectrometer having a generally circular outer electrode and an inner electrode having a generally circular outer periphery. An ion-receiving annulus is defined in between the outer electrode and the inner electrode with the electrodes being structured to create an electric field therebetween. A magnetic field generator is structured to create a magnetic field oriented generally perpendicular to the electric field. An ion beam source for introducing ions into the annulus for travel therearound is provided. An ion exit for discharge of the ion from the annulus and an ion collector for receiving the discharge ions are provided.

In one embodiment, the inner electrode is generally cylindrical and of solid cross-section and in another it has a hollow interior. The ion beam source and ion exit are so positioned that, with respect to the annulus, that the ions travel circumferentially, preferably, at least about 45 degrees between entry and exit to obtain the desired multiple cycloid effect. The upper limit of travel can be any desired angle.

The structure and applied electric and magnetic fields may be such that the ions travel in a path that is like a higher order cycloid, such as an epicycloidal or hypocycloidal path.

The electric field may have a plurality of concentric equal potential circular field lines, each having a potential proportionate to the distance from the center of the mass spectrometer such that the field increases with increasing distance from the center.

It is an object of the present invention to provide a cycloidal mass spectrometer having a circular, elliptical or other suitable configuration and providing highly efficient operation.

It is a further object of the present invention to provide a circular cycloidal mass spectrometer wherein the number of electrodes employed to create the electric field may be reduced as compared with prior art linear configurations.

It is a further object of the present invention to provide such a circular cycloidal mass spectrometer which has reduced dimensions as compared with prior art mass spectrometers.

It is yet another object of the present invention to provide a circular cycloidal mass spectrometer which is adapted to be employed for Fourier transform mass spectrometry.

It is yet another object of the present invention to eliminate the need for stacked electrically conductive plates, through the use of circular configuration, in a cycloidal mass spectrometer.

It is yet another object of the invention to provide such a system wherein neither the starting energy nor the starting angle of the ions influences the character of the trajectory.

These and other objects of the invention will be more fully understood from the following detailed description of the invention on reference to the illustrations appended hereto.

DESCRIPTION OF THE PREFERRED EMBODIMENTS

Referring again to FIG. 1, there is shown x-y-z coordinate axes with pole pieces 3,4 creating an applied magnetic field parallel to the z axis, causing a charged particle to move in circular paths 2. The precise circular path 2 will be determined by the ion mass, charge, speed and the magnetic field strengths.

Figure 1:
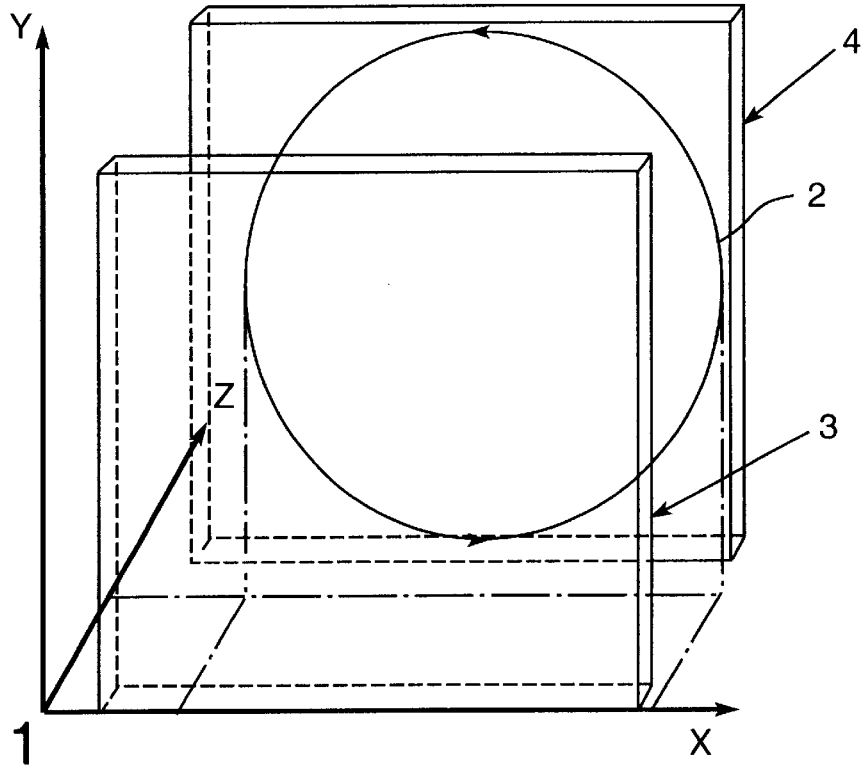
FIG. 1 represents an underlying known concept of a charged particle's circular path of movement in a uniform magnetic field.

Referring again to FIG. 2, there is shown the same magnetic field as in FIG. 1 oriented parallel to the z axis and an electrical field oriented parallel to the y axis. The path of travel of the ions is represented by 6 and provides a plurality of closed loops such as 8 and 10. The cyclotron frequency refers to the elapsed time periods between the particle leaving and returning to a point of its trajectory. For example, a time period $t_X$ shows the elapsed time between the particle going from point "a" to point "b". The distance between two equivalent points on a linear cycloid is the so-called "pitch." During the motion from a to b in FIG. 2, the particle flew an angle in space of 360° or $2\pi$. This corresponds to one revolution in FIG. 1 which requires the time $t_X$ described by the inverse cyclotron frequency.

The time $t_X$ does not depend on the special form and length of the trajectory, as long as the magnetic field is uniform. Any trajectory completing an angle of 360° in a plane perpendicular to the magnetic field takes the same time $t_X$ for a given mass-to-charge ratio and a given magnetic field. Particles with different molecular weights return at different pitches.

Figure 2:
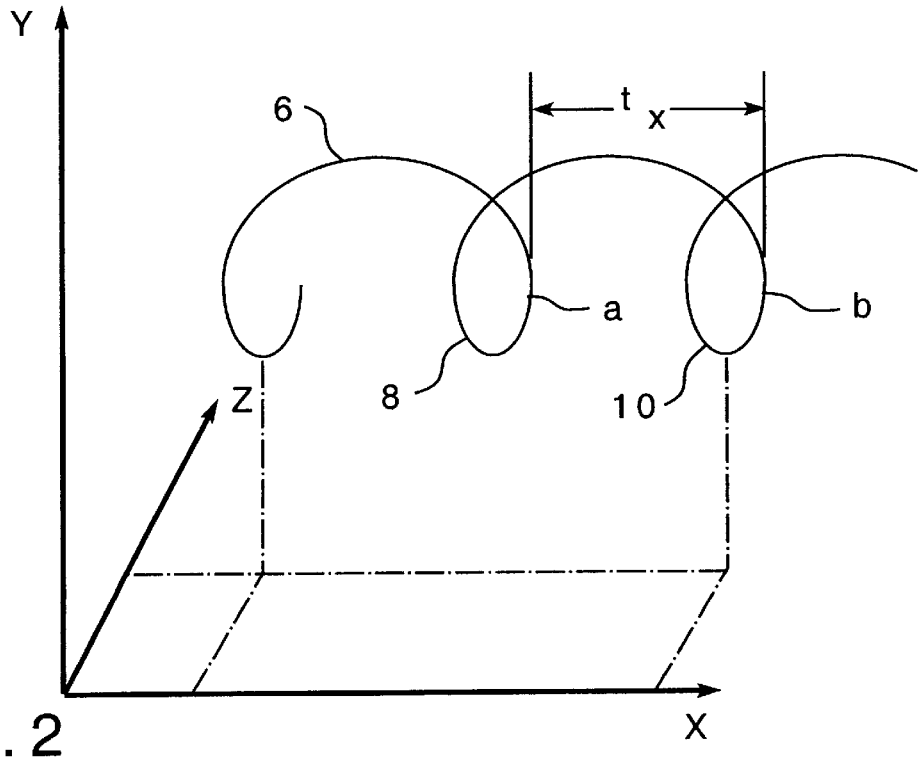
FIG. 2 shows the superimposition of an electric field over a magnetic field and the motion of the particle imposed by both fields.
Figure 3:
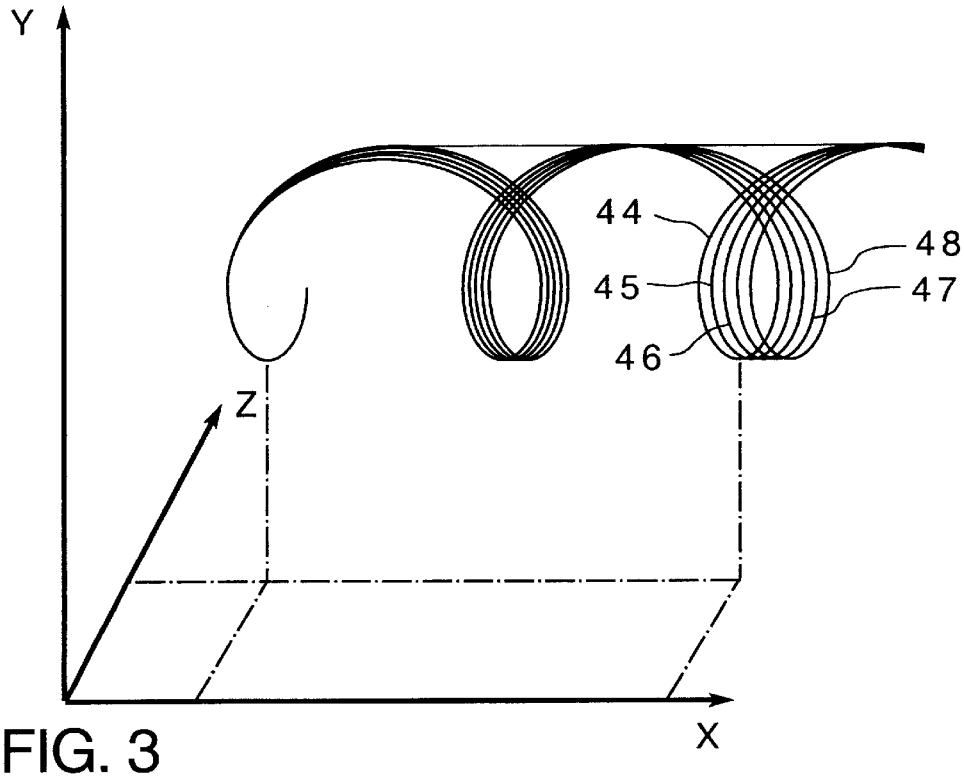
FIG. 3 illustrates a plurality of particles of different molecular weights returning at difference pitches to equivalent points of their trajectory.

As shown in FIG. 3, wherein the magnetic field is parallel to the z axis and the electric field, which is perpendicular thereto, is parallel to the y axis, a plurality of particles identified by the numbers, 44, 45, 46, 47 and 48 corresponding to differences in atomic mass units are travelling in relative spaced positions, while having the general path shown in FIG. 2. These differences are due to the differences in molecular weight.

The magnetic fields may be generated by a permanent magnet or an electromagnet.

Figure 4:
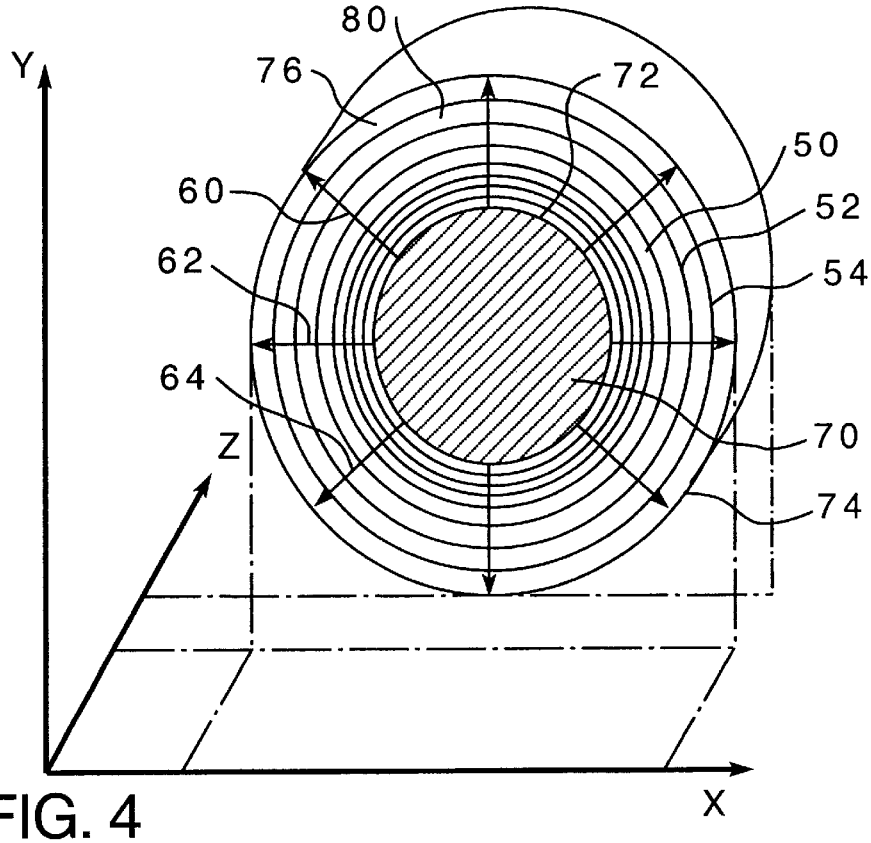
FIG. 4 illustrates schematically an electric field and potential lines inside a capacitor between two concentric cylinders.

Referring to FIG. 4, there is shown schematically a plurality of concentric potential lines, such as lines 50, 52, 54, for example, with the generally radial electric field lines such as 60, 62, 64 extending from the inner electrode 70, which is generally of solid cross-sectional cylindrical shape and the outer concentric sleeve-like electrode 74. This produces circular symmetry of the electric field. The inner electrode 70 has an outer generally circular circumferential face and the outer electrode 74 has an inner generally circular surface 76 with an annulus 80 defined therebetween.

Referring still to FIG. 4, the inner electrode 70 has a solid cylindrical configuration composed of a suitable electrically conductive, nonmagnetic material such as copper or aluminum. Spaced radially outwardly therefrom, is the annular outer electrode 74. The distance between inner surface 76 of outer electrode 74 and outer surface 72 of inner electrode 70 providing an annular region for ion travel.

Figure 5:
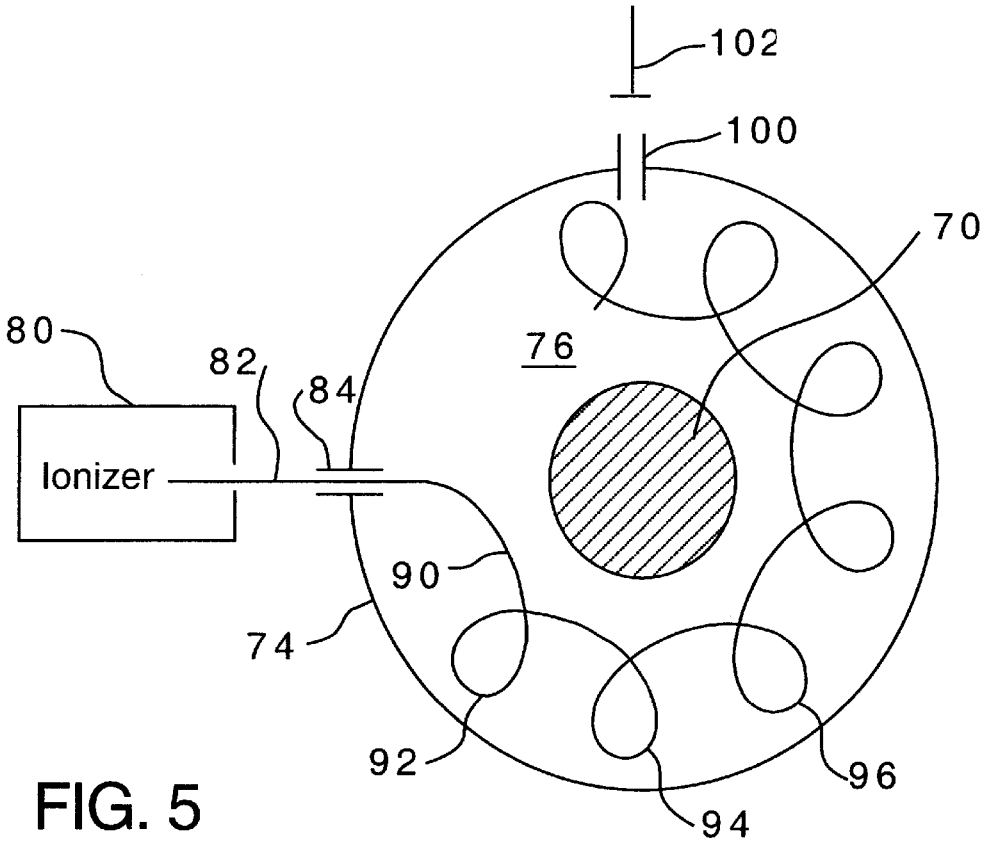
FIG. 5 is a schematic illustration of one embodiment of the present invention showing a cross-section in the x-y plane.

FIG. 5 shows schematically a structure of the type shown in FIG. 4 with the inner electrode 70 and outer electrode 74 defining an annulus 76, which provides a path for flow of the ion beams. This view taken along the x-y plane shows an ionizer 80 providing an output of an ion beam 82, which passes through injection electrodes 84 and travels in the path 90, which provides repeating loops such as 92, 94, and 96. The ions emerge from the ionizer between exit electrodes 100 and are collected on ion collector 102. In the form shown, the ion beam travels approximately 270 degrees within the annulus 76 beginning at injection electrodes 84 and ending at exit electrodes 100. In the form of apparatus shown, the exit electrodes 100 will preferably be positioned about 45 to 315 degrees from injection electrodes 84. It will be appreciated that, in general, it will be preferred to have the ion beam travel at least about 45 degrees within the annulus 76. Any upper limit of ion beam travel, which achieves the desired result, can be employed. The upper limit, for example, may be substantial whole or fractional multiples of 360 degrees which can be greater than or less than 360 degrees. This permits the desired multiple cycloid effects. If desired, paths of travel greater or less than this preferred range may be employed depending on the desired number of cycloids. In this embodiment, the outer electrode 74 is connected to a source of voltage while the inner electrode 70 is connected to the electrical ground of the system. The separation function is created by the cylindrical structure of the analyzer that is a cylindrical capacitor of sufficient lend measured in the z axis (into and out of the page) to provide the ideal field between the electrodes 70, 74. It, therefore, does not depend on the manner in which the ions are brought into the separator.

Figure 6:
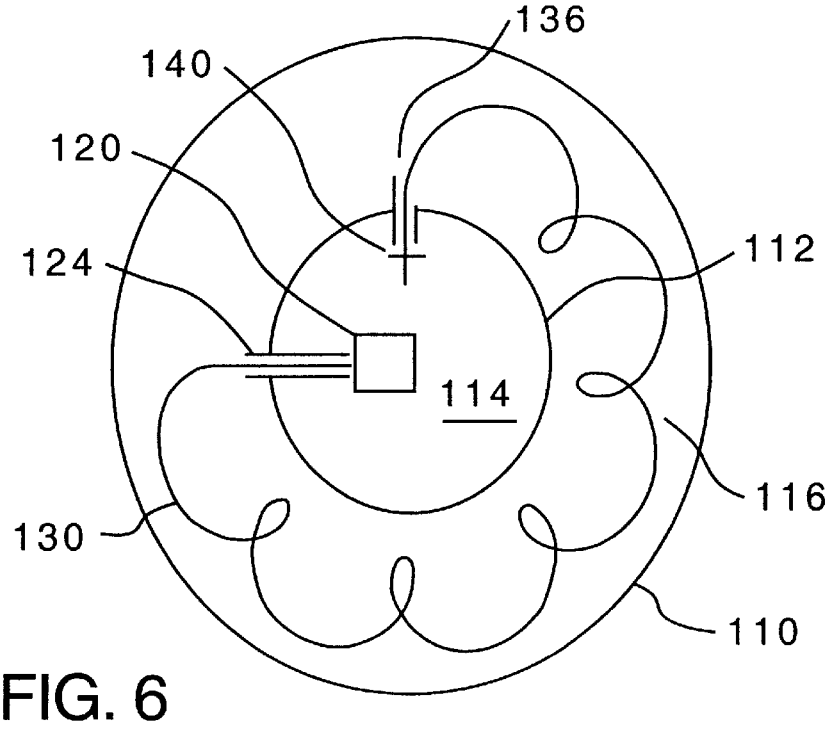
FIG. 6 is a schematic illustration of an alternate embodiment of the circular cycloidal mass spectrometer of the present invention showing a cross-section in the x-y plane.

Referring to FIG. 6 and another embodiment of the invention, a substantially continuous outer electrode 110 cooperates with a hollow inner electrode 112, which has an inner passageway 114. An annulus 116 for flow of an ion beam is defined between the outer electrode 110 and the inner electrode 112. In this embodiment, however, the ionizer 120 is disposed within the hollow 114 and emits ion beams between injection electrodes 124 into the annulus 116 wherein the ion beam 130 travels in a cycloidal path. The exit electrodes 136 are provided within the hollow 114 of inner electrode 112 as is the ion collector 140.

Figure 7:
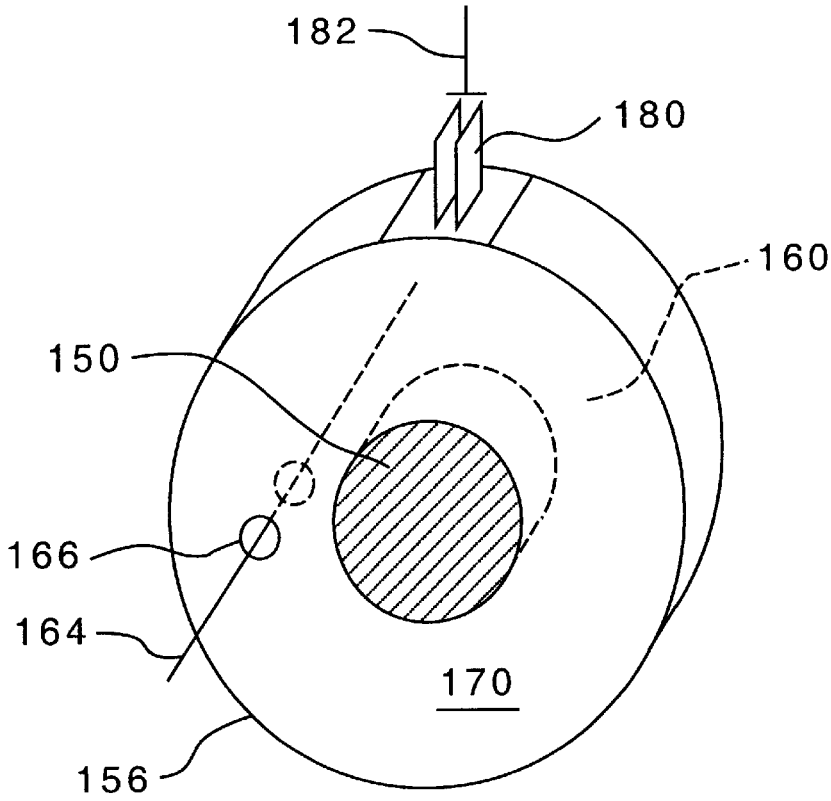
FIG. 7 shows schematically an ionizing electron beam directed through the analyzer in a path generally parallel to its cylindrical axis.

Referring to FIG. 7, there is shown another arrangement of analyzer wherein the inner electrode 150 cooperates with the outer electrode 156 to define an annulus 160 therebetween for travel of the ion beam. An electron beam 164, which is provided by a suitable ionizer (not shown), exits through an exit aperture 166 in the wall of separator 170 and impinges on the anode (not shown). The ion beam is created where the electrons travel through annulus 160 interiorly of the separator 170. The ion beam exits through exit electrodes 180 and impinges on ion collector 182. It will be appreciated that in this embodiment, the electron beam 164 enters in a direction generally parallel to the axis of inner electrode 150.

Figure 8:
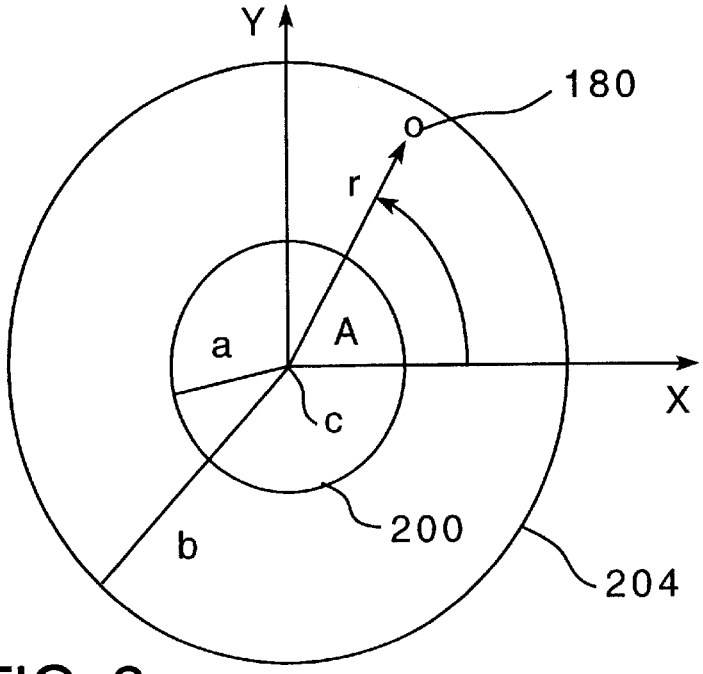
FIG. 8 illustrates a charged particle moving in a magnetic field perpendicular to a concentric electric field within a cylindrical capacitor.

FIG. 8 shows, schematically, a charged particle 180 positioned at a distance r from the center c of inner electrode 200, which is at ground potential. Inner electrode 200 has a radius a and outer electrode 204 has a radius b. It is assumed that the particle is displaced from the x axis by an angle A.

Figure 9B:
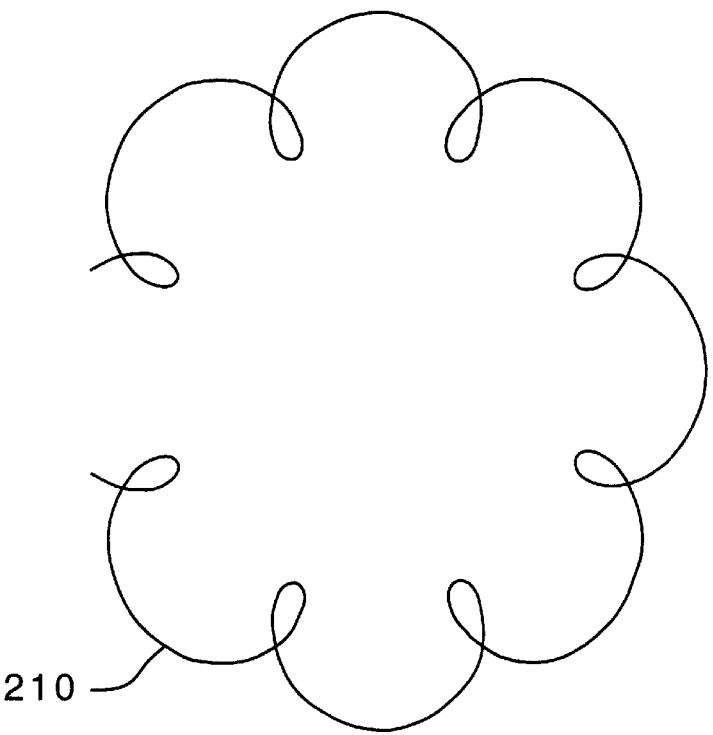
FIGS. 9(*a*) and 9(*b*) illustrate, in FIG. 9(*a*), the physical concept of the generation of an epycycloid path of movement of ions and the resultant path as shown in FIG. 9(*b*).
Figure 9A:
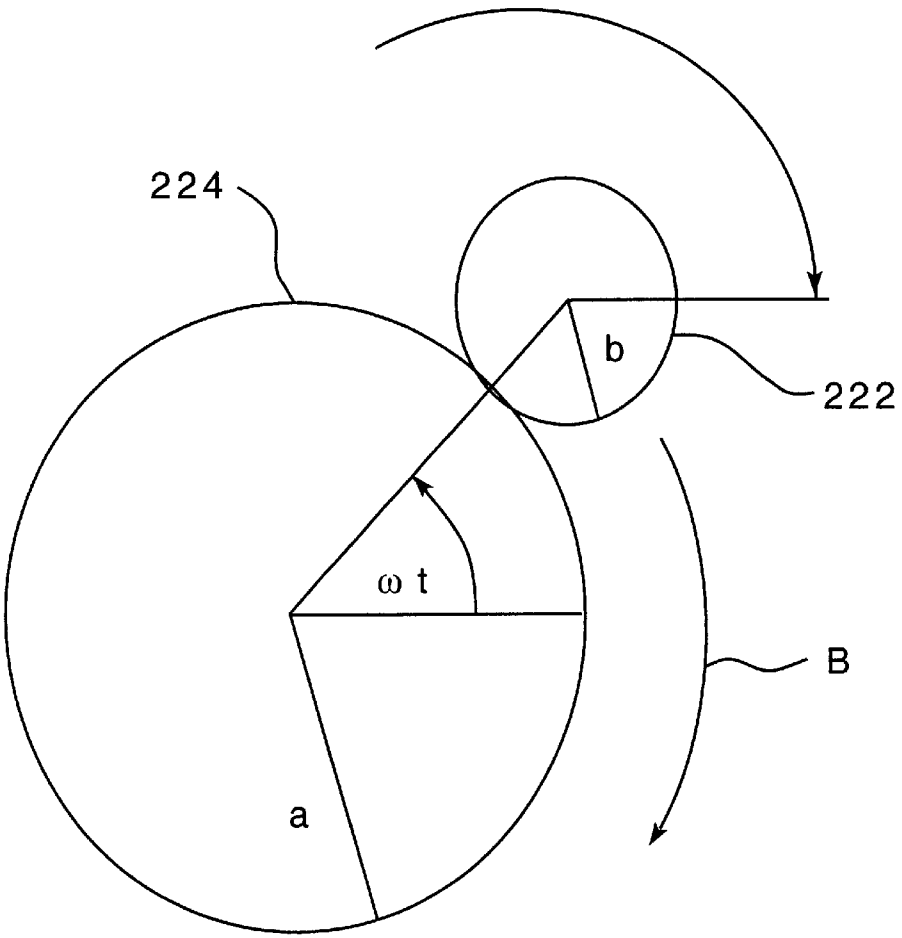
Figure 10B:
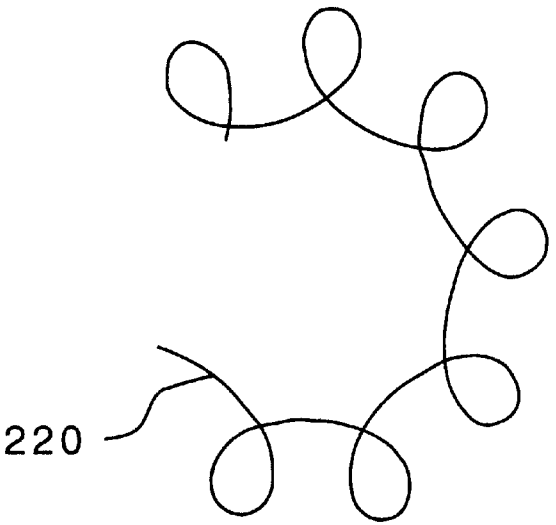
FIGS. 10(*a*) and 10(*b*) illustrate, in FIG. 10(*a*), a physical concept of the generation of a hypocycloid path and, in FIG. 10(*b*), the corresponding path of movement of ions.
Figure 10A:
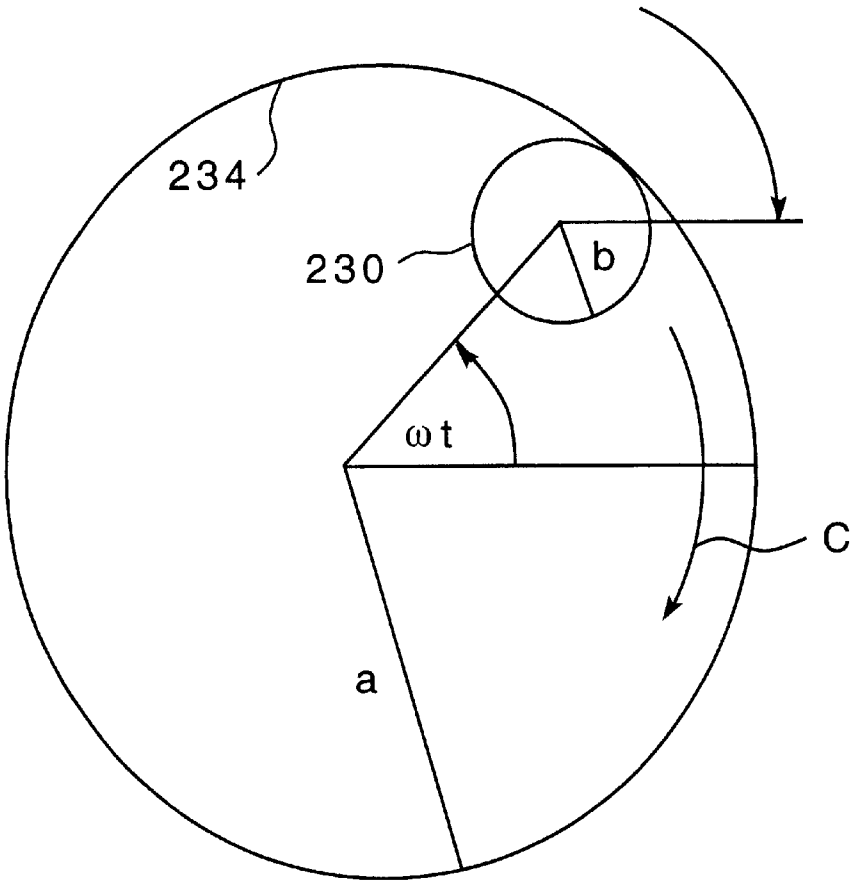

It is preferred that the intraelectrode annular space between inner electrode 200 and outer electrode 204 be maintained at a relatively high vacuum. It has been shown mathematically that the motion created in this environment and under these conditions produces configurations closely related to epicycloids as shown by 210 in FIG. 9(*b*) or hypocycloids 220 as shown in FIG. 10(*b*). In considering the epicycloids as shown in FIGS. 9(*a*) and (*b*), one might consider a point on a spoke of a wheel 222 of radius b rolling around the outer circumference 224 of a circle with a radius a in the direction shown by arrow B at an angle wt. The hypocycloids shown in ion path 230 in FIGS. 10(*a*) and 10(*b*), however, are generated where the wheel 230 moves along the inner surface of circle 234 having a radius a and through an angle wt in the direction shown by arrow C. The trajectories shown in FIGS. 9(*a*) and 9(*b*) result from the separator described above and are similar to epicycloids if the electric field accelerates the particle toward the center and hypoclycloids for the opposite field direction.

Figure 11:
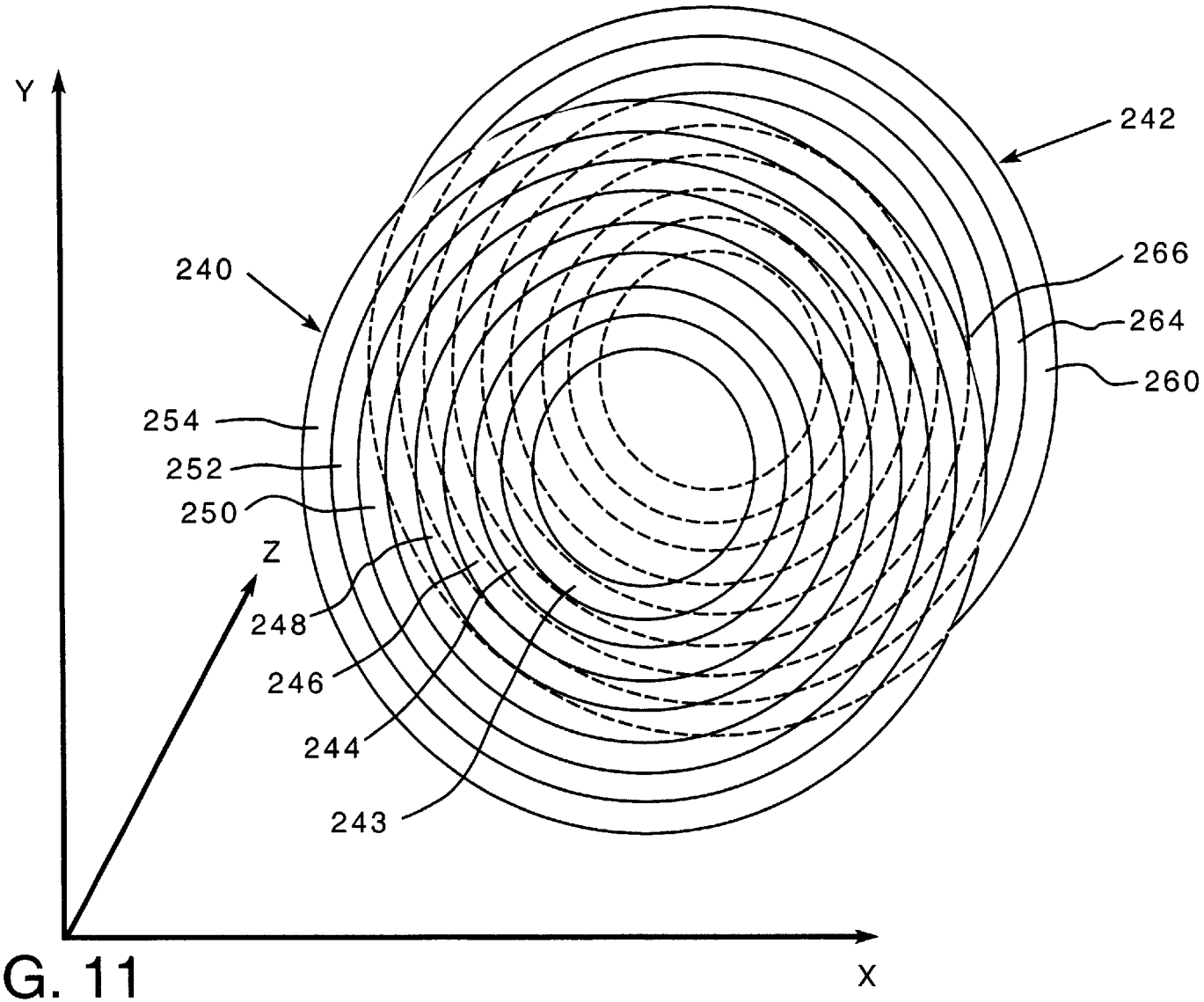
FIG. 11 shows schematically a plurality of concentric electrodes to create special electric field profiles.

Referring to FIG. 11, and a special case of uniform circular symmetry, there is shown a series of concentric electrodes at the face 240 and back 242 of the cylindrical structure. For example, the face has a series of individual annular electrodes 243, 244, 246, 248, 250, 252 and 254. In spaced relationship on the rear surface are a corresponding series of adjacent concentric electrodes 260, 264, and 266, which are spaced from the front face 240. The trajectories of this embodiment approximate the epicycloids and hypocycloids with the difference being the addition of a to b for epicycloid and the subtraction of b from a in the case of the hypocycloid formulas.

Figure 12:
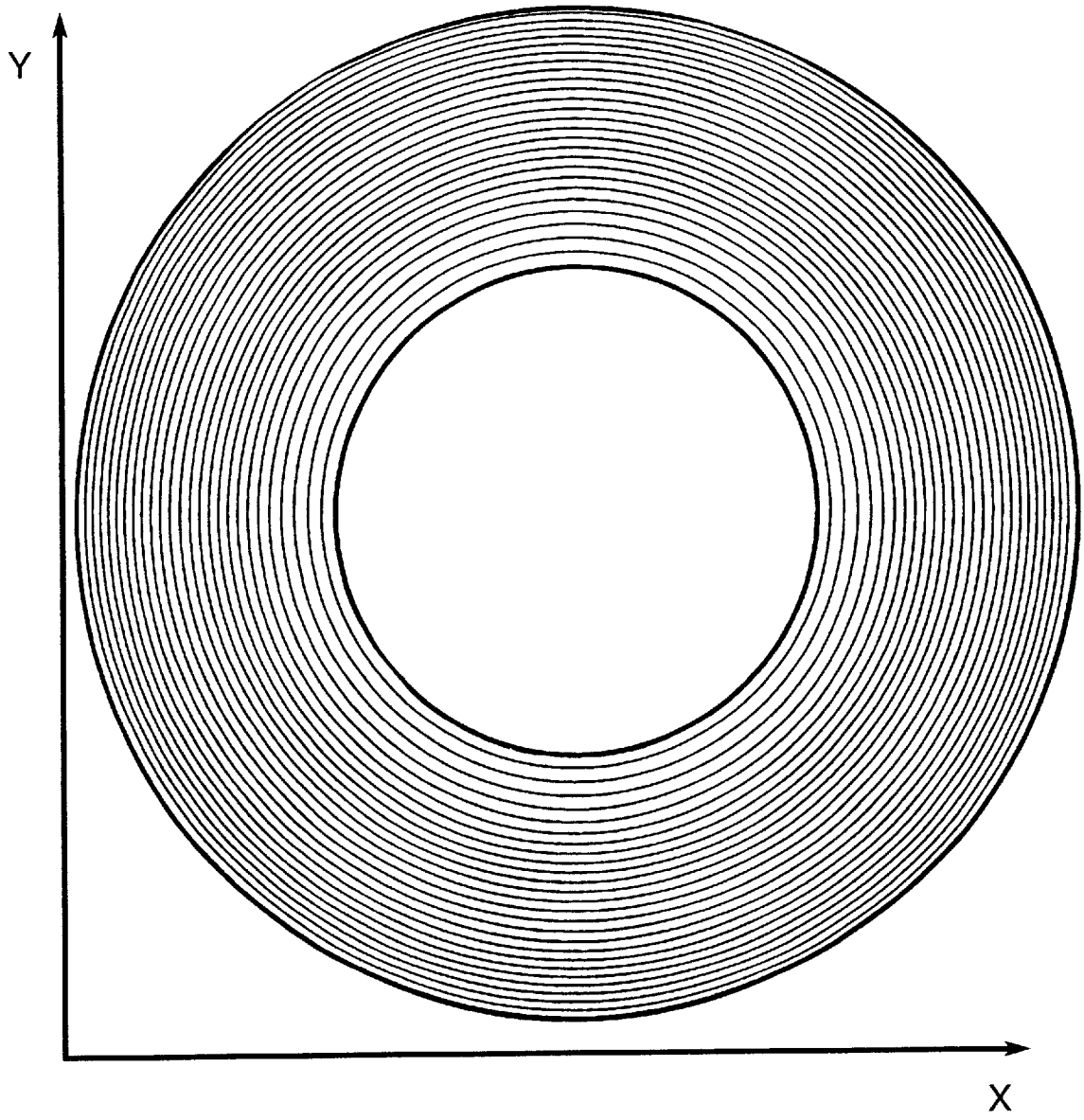
FIG. 12 shows equipotential lines in a circular electric field increasing proportional to the distance from the center.

It will be appreciated that for purposes of mass spectrometric separation, it is important to have focusing properties to reduce the effect of spread in initial energy and starting angle of the ions. Linear cycloidal mass spectrometers are double focusing as a result of the geometric properties of the linear cycloid. To achieve this effect in circular arrangement, an electric field that increases proportionately to the distance from center is employed. This results in an image of the linear cycloid that is in effect squeezed at any point, depending on the radial distance from the center. As a result, the field lines which are toward the outer portion are closer to each other. FIG. 12 shows a set of equipotential lines with uniform difference in voltage between adjacent lines. The field strength would increase with the distance from the center. Employing the electrode structure of FIG. 11, if the appropriate voltages are connected to each electrode, the type of field shown in FIG. 12 can be approximated.

Figure 13:
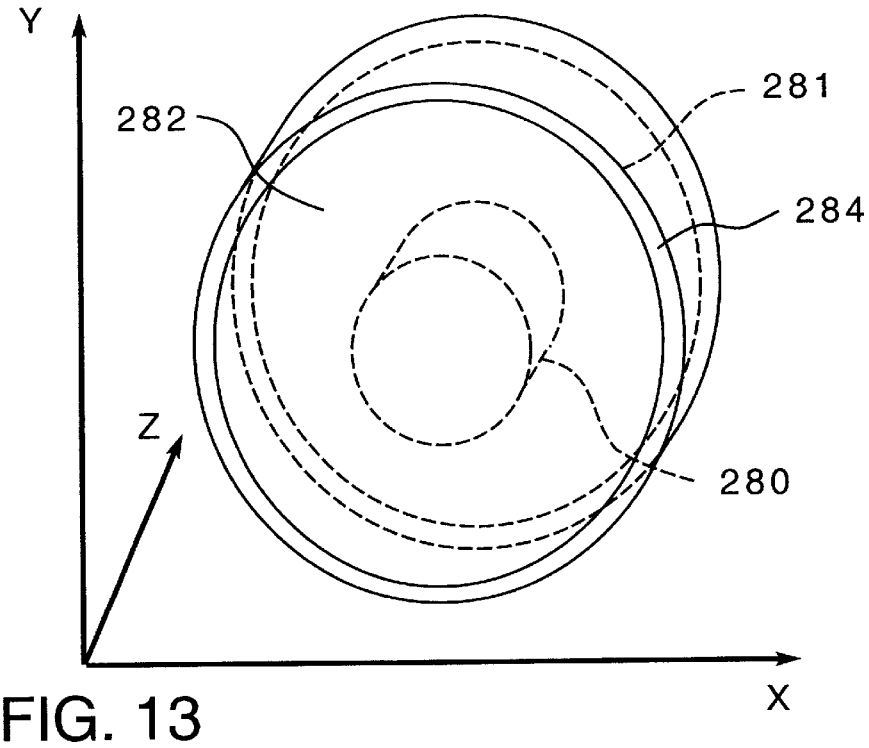
FIG. 13 shows schematically a simplified alternative having an inner electrode and an annular outer electrode.

The electrodes may be made of any suitable material such as stainless steel, for example. FIG. 13 shows a simplified alternative wherein an inner electrode 280 is spaced from an outer electrode 284, which is an annular ring joined to separators 281, 282.

Figure 14:
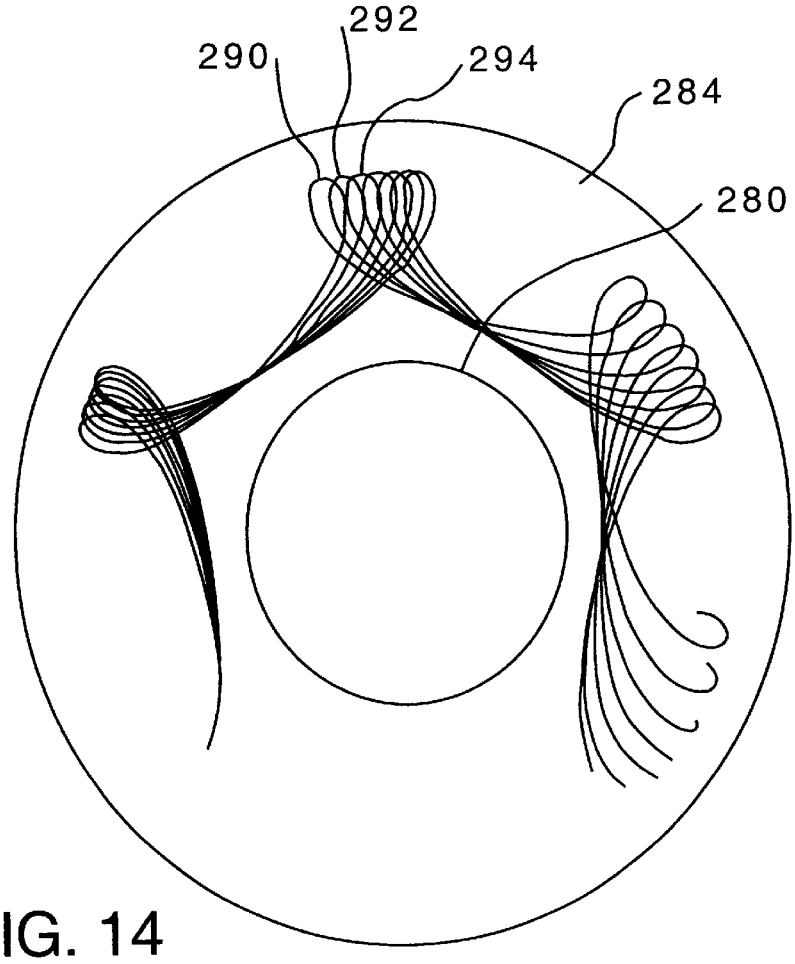
FIG. 14 shows schematically a plurality of ions having different mass-to-charge ratios separated within the type field shown in FIGS. 11 through 13

FIG. 14 illustrates an example of how ions with different mass to charge ratios separate in this type of field with the inner electrode being represented as cylinder 280 and the outer electrode being ring 284. It will be noted that a plurality of generally similar shapes displaced from each other, such as ion beams 290, 292, and 294, for example, are provided. This corresponds to the double-focusing properties of the standard cycloidal mass spectrometer.

Figure 15:
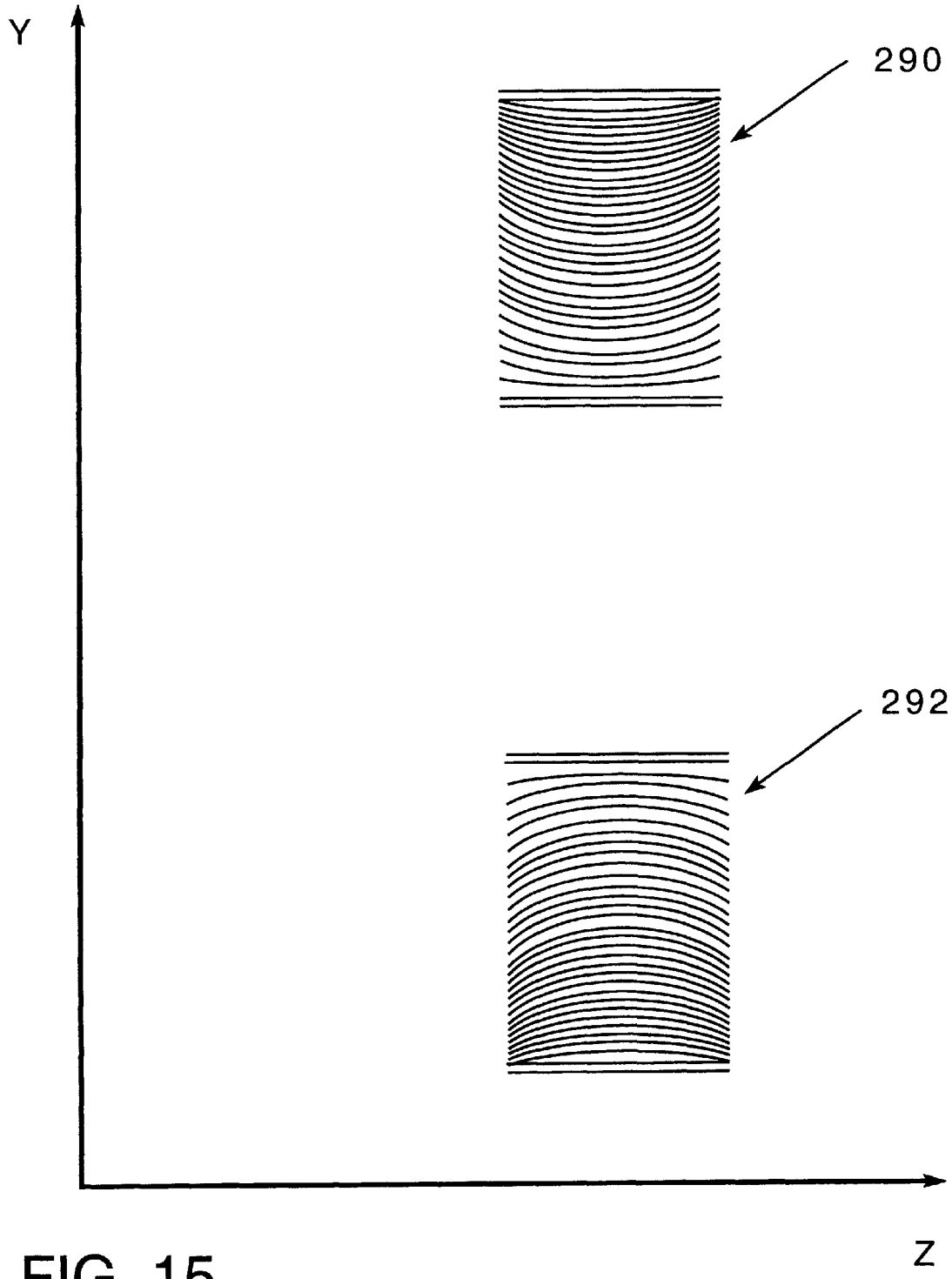
FIG. 15 illustrates schematically equipotential lines in a projection into the z-y plane.

Referring to FIG. 15, there is shown the confinement capability of the field structure. More specifically, equipotential lines in the projection into the y-z plane are shown in the groupings at 290 and 292. The concave shape of the field retains the ions from escaping into the z direction. This effect is important for flying multiple cycloids and suggests the use of the separator as a storage device like the ion trap. The number of ions trapped in the separator can be increased by time to gain sensitivity by enrichment. On the other hand, a group of confined circulating ions can be detected by the radiation of their cyclotron frequency and the methods of Fourier transform mass spectrometry.

Figure 16:
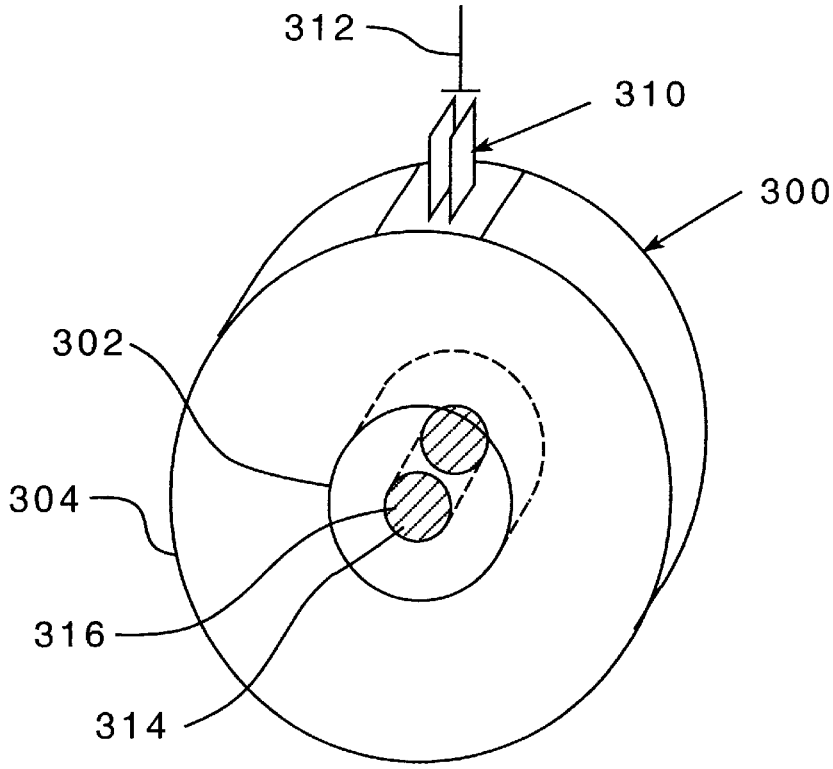
FIG. 16 is a modified embodiment similar in some respects to the embodiment of FIG. 7 showing the use of a heating element.

Referring to the embodiment of FIG. 16, there is shown a cycloidal mass spectrometer 300 which has an inner electrode 302, an outer electrode 304, and an annular ion transport passageway therebetween. The exit electrodes 310 cooperate with the ion collector 312. The inner electrode 302 has a bore 314 therethrough which, in the form shown, contains a heating element 316, the heater serves to clean the surfaces of undesired contaminates, absorbed gasses and water. This is particularly helpful with low level analysis.

The heating element may be of any desired capacity and may be energized electrically.

Figure 17:
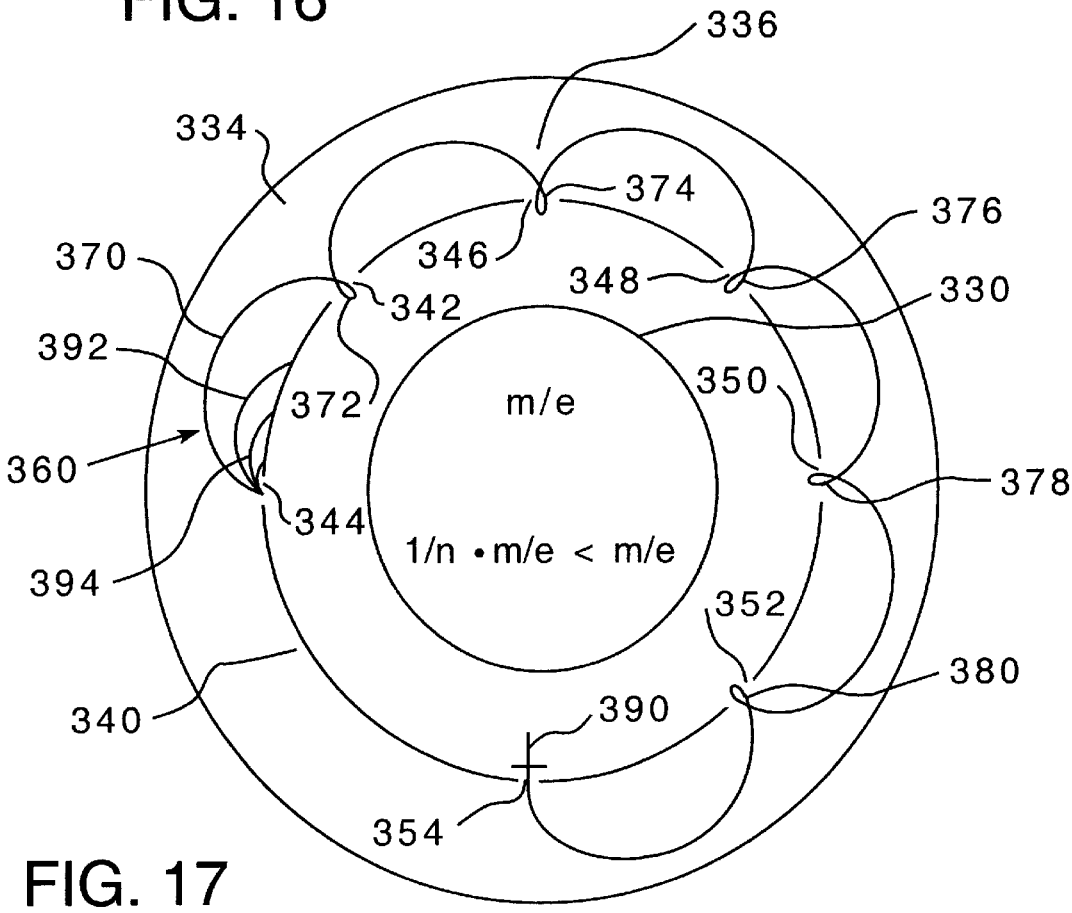
FIG. 17 shows a modified embodiment of the invention having a filter plane.

Referring to FIG. 17, there is shown a cycloidal mass spectrometer which may be generally similar to that of FIG. 5 or FIG. 6, but has an enhancement. This embodiment has an inner electrode 330 spaced from an outer electrode 334 to define an annular region 336 within which ions may travel under the influence of the imposed electric field and magnetic field. Interposed between inner electrode 330 and outer electrode 334 is a filter plane element 340 which has a plurality of slots or openings such as 342, 344, 346, 348, 350, 352 and 354 and may be made of stainless steel in a foil thickness, for example. In the form shown, the starting ions 360 travel in a generally clockwise path through annular region 336 and, in those instances where the path of travel of an ion beam such as 370 coincides with an opening such as 342, a cycloid 372 appears. See also cycloids 374, 376, 378, 380. Ultimately the ion beam emerges and is received by collector 390. It is noted that the ion beam 370 has a particular m/e with ion beams such as 392, 394 having $1/n \cdot m/e \leqq m/e$ falling short of the first opening 342.

Figure 18:
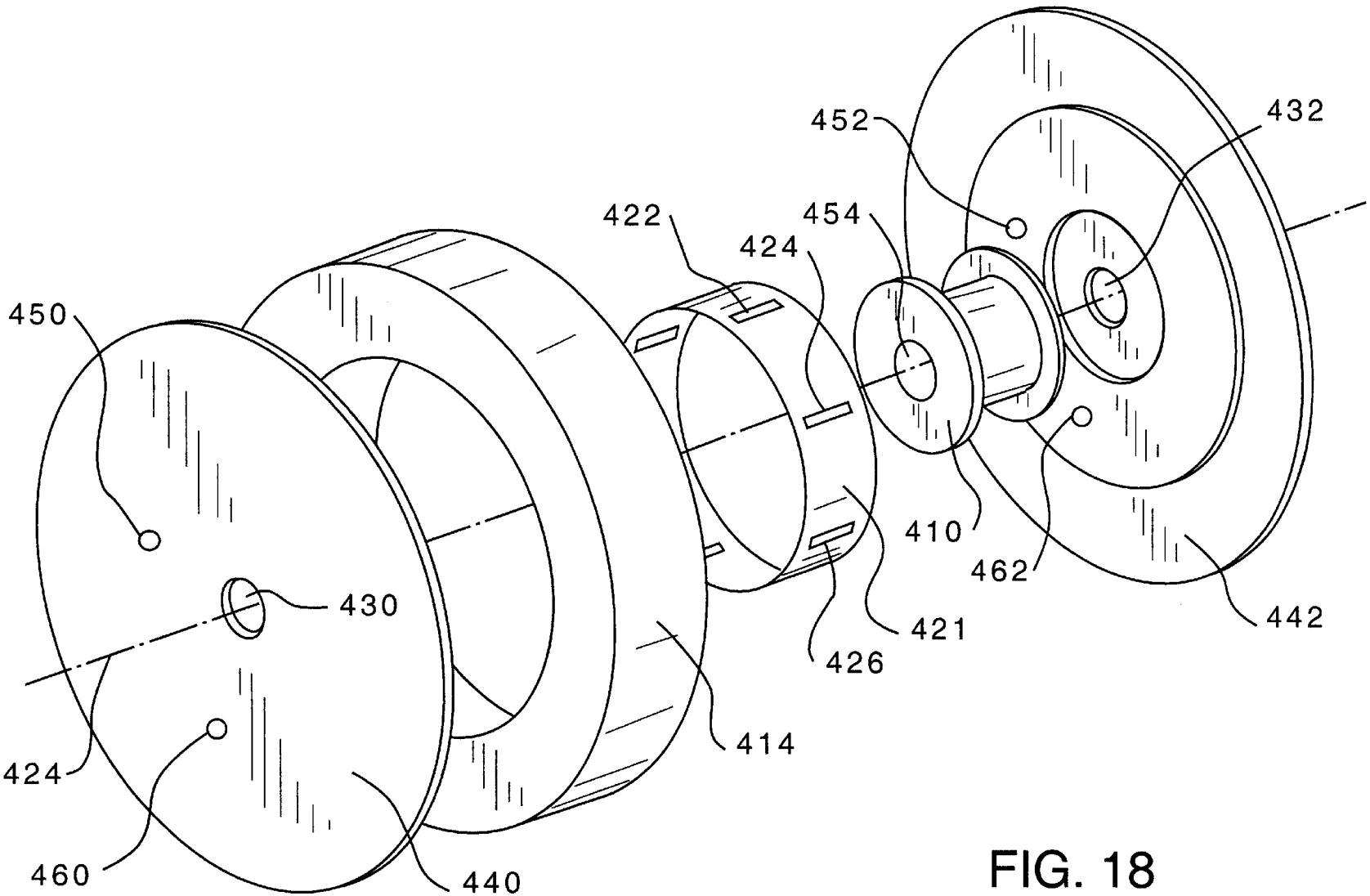
FIG. 18 is an exploded view of a separator employable in the present invention.
Figure 19:
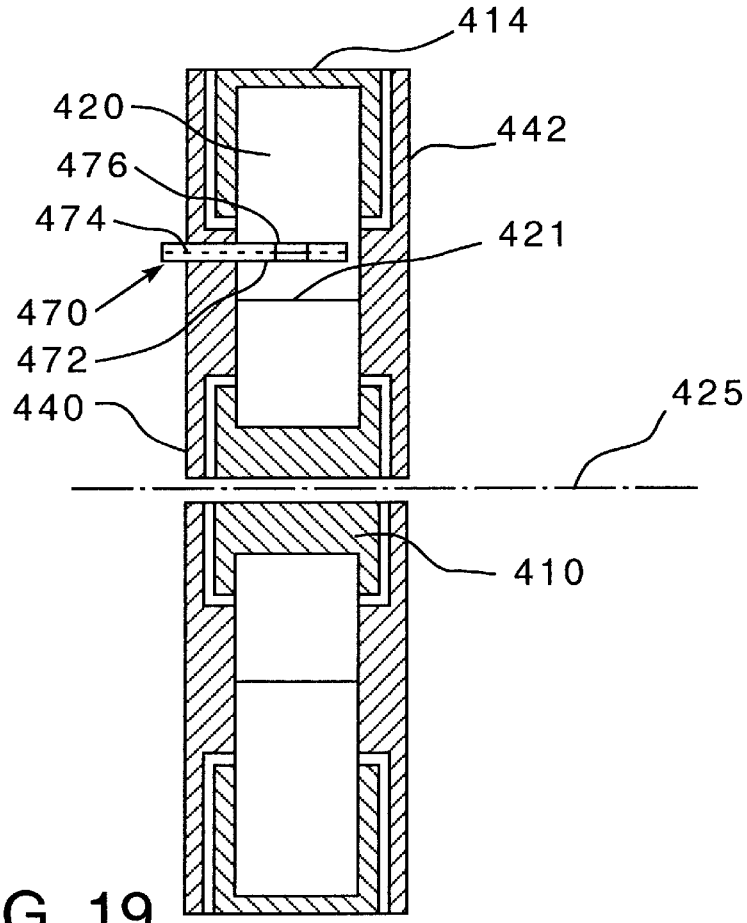
FIG. 19 is a cross-sectional illustration taken through the separator of FIG. 18 in assembled, as contrasted with, exploded form.

As shown in the embodiment of FIGS. 18 and 19, the separator construction may have a generally spool shaped inner electrode 410 which cooperates with the outer electrode 414 to define the annular region 420 within which the ions will travel. A filter plane 421, having a series of generally parallel slots such as 422, 424, 426, for example, passing therethrough, is interposed and functions in a manner described in connection with FIG. 17. The axis of rotational symmetry 425 passes through the aligned openings 430, 432, in ground electrodes 440, 442 and passageway 454 in inner electrode 410 An ion beam entrance 450 is provided in ground electrode 440 and an ion beam exit 452 is provided in ground electrode 442. Collector feed-through openings 460, 462 are provided. As best seen in FIG. 19, a collector 470 extends into annular region 420 and includes an outer conductor 472, an inner conductor 474 and collector slits such as 476 in the outer conductor 472. The slits in the outer conductor 472 let the ions pass to the inner conductor 474 of collector 470. Tie overall outer diameter of the collector 470 may be on the order of 1 mm to keep disturbance of the field at a low level.

Figure 20:
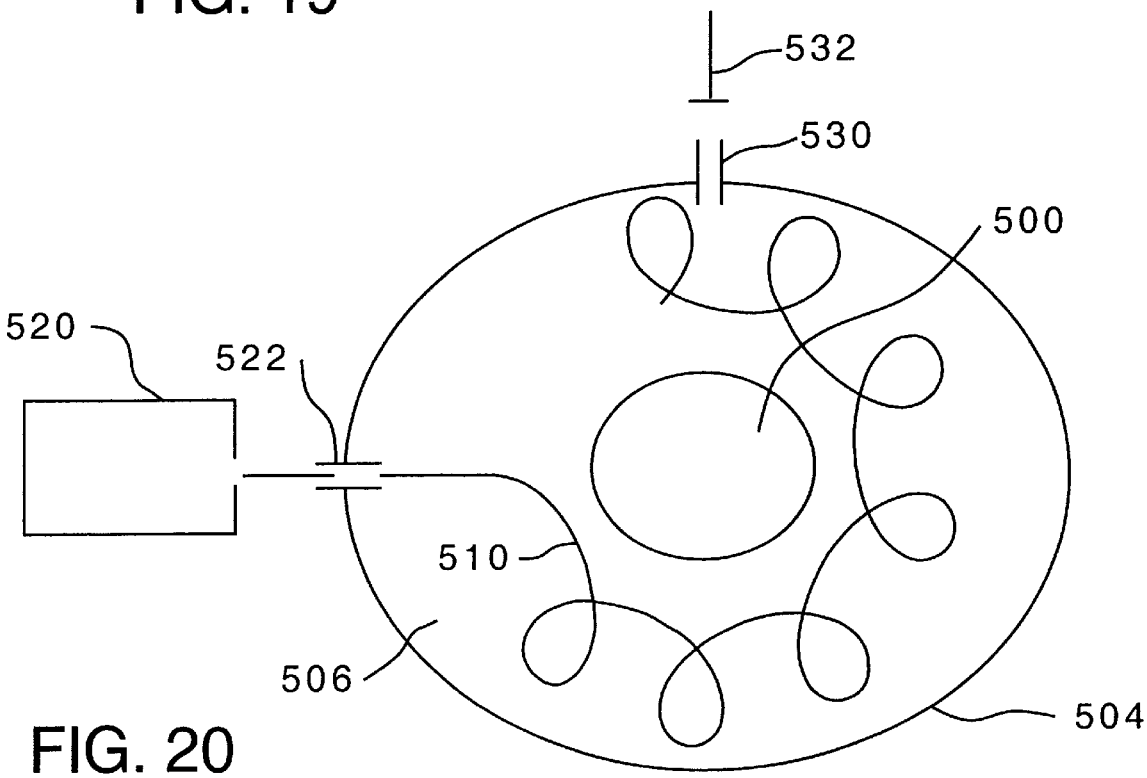
FIG. 20 is an illustration of a cycloidal mass spectrometer, having a noncircular configuration.

For convenience of disclosure herein, specific reference has been made repeatedly to cycloidal mass spectrometers having generally circular exterior configurations on the inner electrode and generally circular configuration on the outer electrode to define therebetween a generally circular, annular path for travel of the ion beam. It is not essential, however, that the configuration be circular and other non-linear configurations, while perhaps not as advantageous economically in respect of equipment production, may be employed while obtaining substantial benefits of the present invention. As shown in FIG. 20, an inner electrode 500, having a generally elliptical exterior configuration cooperates with an outer generally elliptical-shaped electrode 504 to define an annular region 506 which serves as the path of travel for ion beam 510. Ionizer 520 cooperates with injection electrodes 522 to emit the ion beam 510 which, in the form shown, travels in a counter-clockwise direction preferably greater than 270° to adjacent the exit electrode 530 and ion collector 532.

Figure 21:
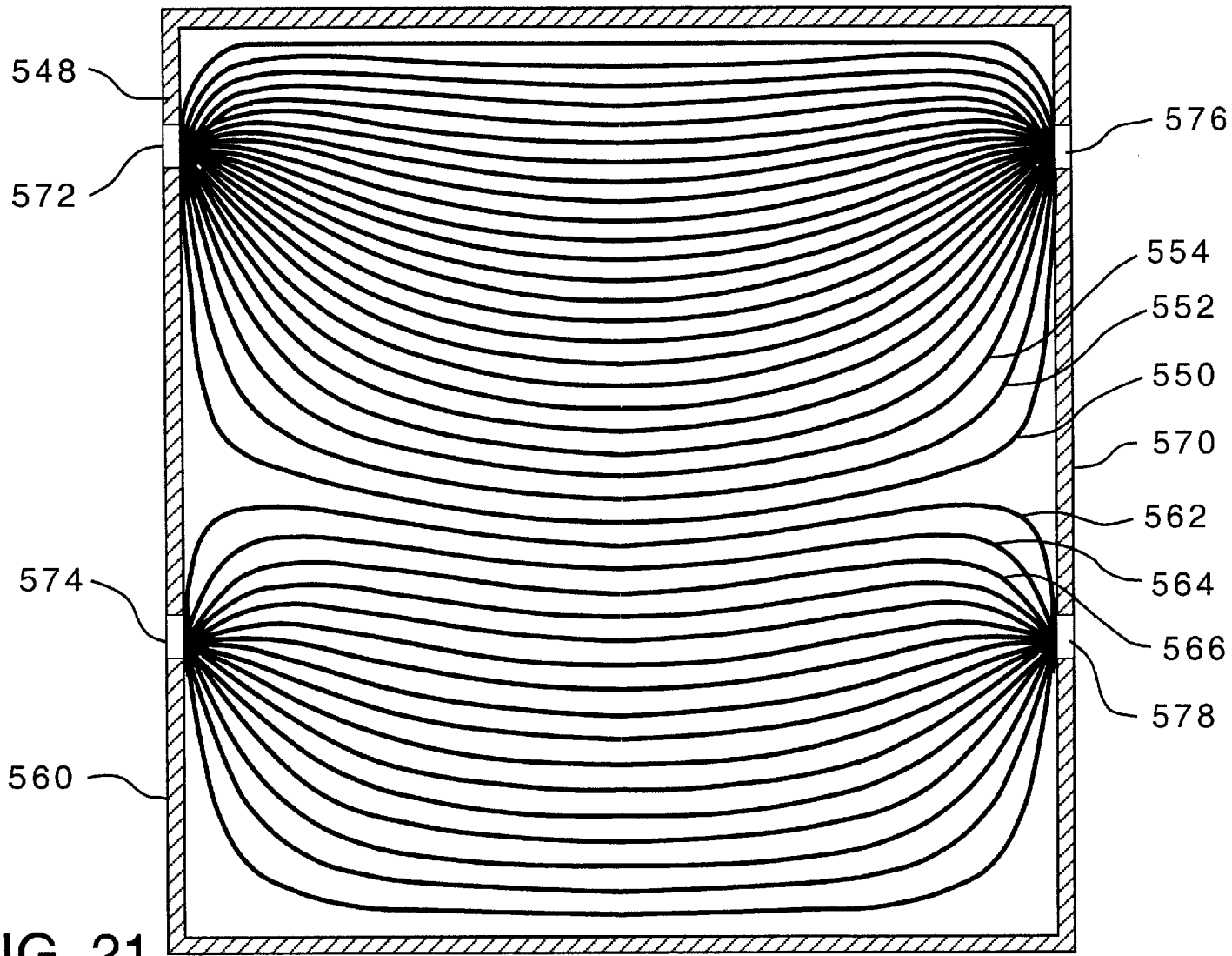
FIG. 21 is a schematic illustration of a cross-section through the annular region in which ions travel in the y-z plane.

Referring to FIG. 21, there is shown a cross-section taken through the annular region of ion travel in the y-z plane. In the form shown, the outer electrode 548 is negative and has a plurality of curved equipotential lines, such as 550, 552, 554. The equipotential lines have equal difference in voltage between two adjacent lines. The inner electrode 560 is positive and has a plurality of curved equipotential lines such as 562, 564, 566. The ground electrode 570 is disposed therebetween with gaps 572, 574, 576, 578 separating the same. The curvature of the equipotential lines in FIG. 21 tend to keep the lines close to the center of the x axis. Ions to the right and left of center experience a force toward the center, thereby resisting ion escape in the z direction. This electrode structure also serves to avoid the number of cycloidal flown by a given ion depending upon the average distance from the center.

It will be appreciated, therefore, that the present invention has provided an effective cycloidal mass spectrometer of circular and other shapes, which permits the reduction in number of electrodes, reduction in size as well as cost of manufacture and may, depending on configuration, take advantage of symmetry in its functioning. As the analyzer surface is reduced, this results in less outgassing and desorption effects. Further, trajectories with many cycloids may be achieved without increasing the dimensions of the analyzer and, as a result, resolution is enhanced.

Whereas particular embodiments have been described hereinabove, for purposes of illustration, it will be evident to those skilled in the art that numerous variations of the details may be made without departing from the invention as defined in the appended claims.

What is claimed is:

1. A cycloidal mass spectrometer comprising an outer electrode, an inner electrode, an ion-receiving annulus defined between said outer electrode and said inner electrode, said electrodes beings structured to create an electric field therebetween, a magnetic field generator structured to create a magnetic field oriented generally perpendicular to said electric field, an ion beam source for introducing ions into said annulus for generally circumferential travel therearound, an ion exit for discharge of ions from said annulus, and an ion collector for receiving said discharged ions.

2. The cycloidal mass spectrometer of claim 1 including said outer electrode having a generally circular interior surface, and said inner electrode having a generally circular outer periphery.

3. The circular cycloidal mass spectrometer of claim 2 including said inner electrode being generally cylindrical.

4. The circular cycloidal mass spectrometer of claim 2 including said ion beam source having an ionizer disposed outward of said outer electrode for creating said ion beam, and an ion-receiving opening in said outer electrode for passage of said ion beams therethrough.

5. The circular cycloidal mass spectrometer of claim 4 including said ion exit being circumferentially displaced from said ion receiving opening by about 45 to 315 degrees.

6. The circular cycloidal mass spectrometer of claim 2 including said inner electrode being hollow.

7. The circular cycloidal mass spectrometer of claim 6 including an ion beam source disposed within said inner electrode hollow, and an ion beam entry opening in said inner electrode permitting said ion beam to enter said annulus.

8. The circular cycloidal mass spectrometer of claim 7 including an exit electrode in communication with said inner electrode hollow through an exit opening for receiving ions that have passed through said annulus.

9. The circular cycloidal mass spectrometer of claim 8 including an ion collector disposed within said inner electrode hollow for receiving ions from said exit electrode.

10. The circular cycloidal mass spectrometer of claim 9 including said ion beam entry opening being circumferentially displaced from said exit opening by about 45 to 315 degrees.

11. The cycloidal mass spectrometer of claim 2 including said circular cylindrical mass spectrometer being structured to cause said ion beam to move through said annulus in a path selected from the group consisting of an epicycloid path and a hypocycloidal path.

12. The cycloidal mass spectrometer of claim 1 including said inner electrode being at electrical ground, and said outer electrode being at an elevated voltage with respect to said inner electrode.

13. The cycloidal mass spectrometer of claim 11 including said electric field having a plurality of concentric equipotential circular field lines each having a potential directly proportional to the distance from the center of said mass spectrometer.

14. The cycloidal mass spectrometer of claim 4 including said ion-receiving opening being generally circumferentially positioned on said mass spectrometer.

15. The cycloidal mass spectrometer of claim 3 including said outer electrode having a circumferential opening for receiving said ion beam.

16. The cycloidal mass spectrometer of claim 3 including said cycloidal mass spectrometer having a pair of end walls, and an opening in a said end wall for permitting an ion beam to be introduced into said annulus therethrough.

17. The cycloidal mass spectrometer of claim 16 including said ion exit being disposed at the circumference of said outer electrode.

18. The cycloidal mass spectrometer of claim 1 including said outer electrode having a generally elliptical interior surface, and said inner electrode having a generally elliptical outer periphery.

19. The cycloidal mass spectrometer of claim 1 including an annular filter interposed between said inner electrode and said outer electrode.

20. The cycloidal mass spectrometer of claim 19 including said filter having a plurality of slots therein.

21. The cycloidal mass spectrometer of claim 20 including said slots being circumferentially spaced from each other and generally parallel to each other.

* * * * *

UNITED STATES PATENT AND TRADEMARK OFFICE

CERTIFICATE OF CORRECTION

PATENT NO. : 6,624,410 B1
DATED : September 23, 2003
INVENTOR(S) : Guenter F. Voss It is certified that error appears in the above-identified patent and that said Letters Patent is hereby corrected as shown below:

Column 5,
Line 20, “lend” should read -- length --.

Column 7,
Line 32, after “410” insert a -- . --.

Column 8,
Line 33, “beings” should read -- being --.

Signed and Sealed this

Ninth Day of March, 2004

JON W. DUDAS
*Acting Director of the United States Patent and Trademark Office*